US007140794B2

(12) United States Patent
Redman et al.

(10) Patent No.: US 7,140,794 B2
(45) Date of Patent: Nov. 28, 2006

(54) APPARATUS TO GUIDE LABEL STOCK IN A PRINTER

(75) Inventors: Randall L. Redman, Beavercreek, OH (US); Lee E. Trouteaud, Tipp City, OH (US); Matthew A. Zakel, Englewood, OH (US)

(73) Assignee: Premark FEG L.L.C., Wilmington, DE (US)

( * ) Notice: Subject to any disclaimer, the term of this patent is extended or adjusted under 35 U.S.C. 154(b) by 160 days.

(21) Appl. No.: 10/769,446

(22) Filed: Jan. 30, 2004

(65) Prior Publication Data

US 2005/0169690 A1 Aug. 4, 2005

(51) Int. Cl.
*B41J 11/28* (2006.01)
*B41F 1/28* (2006.01)
*B65H 49/26* (2006.01)

(52) U.S. Cl. ..... 400/613; 400/613.1; 101/407.1; 242/597.5

(58) Field of Classification Search ..... 400/613, 400/613.1; 242/597.5; 101/407.1
See application file for complete search history.

(56) References Cited

U.S. PATENT DOCUMENTS

| | | | | |
|---|---|---|---|---|
| 673,778 A | | 5/1901 | Merritt | |
| 969,146 A | | 8/1910 | Soule | |
| 1,123,052 A | | 12/1914 | Whittier | |
| 1,234,746 A | * | 7/1917 | Fish | 242/578.2 |
| 1,847,567 A | | 3/1932 | Lorenz | |
| 2,010,186 A | | 8/1935 | Goldhammer | |
| 2,673,734 A | | 3/1954 | Reza-Bek et al. | |
| 3,080,135 A | | 3/1963 | Steijn | |
| 3,817,177 A | * | 6/1974 | Van Arnam et al. | 101/288 |
| 3,865,238 A | | 2/1975 | Colaluca | |
| 4,225,097 A | | 9/1980 | Ohtomo | |
| 4,272,201 A | | 6/1981 | Steger | |
| 4,423,946 A | | 1/1984 | Fleck et al. | |
| 4,498,950 A | * | 2/1985 | Sato et al. | 156/577 |
| 5,232,540 A | * | 8/1993 | Southwell et al. | 156/361 |
| 5,486,259 A | * | 1/1996 | Goodwin et al. | 156/384 |
| 5,541,635 A | | 7/1996 | Wills et al. | |
| 5,746,389 A | | 5/1998 | Willmann | |
| 6,164,203 A | * | 12/2000 | Keller | 101/407.1 |
| 6,336,757 B1 | * | 1/2002 | Nishimura et al. | 400/613 |

* cited by examiner

*Primary Examiner*—Ren Yan
*Assistant Examiner*—Wynn Ha
(74) *Attorney, Agent, or Firm*—Thompson Hine LLP

(57) ABSTRACT

A label printing apparatus for accommodating a plurality of widths of rolled label stock is provided. The label printing apparatus includes a frame, a label stock support arm extending from the frame, and a print head located for having label stock pass thereby for printing. The label stock support arm may have at least two stepped regions for supporting rolled label stock, including a first stepped region with edges spaced apart by a first distance corresponding to a first width of label stock and a second stepped region with edges spaced apart by a second distance corresponding to a second width of label stock. One or more label stock guides may include recessed regions for guiding different widths of label stock. A movable wall may also be provided. The various features could also be provided in connection with printers using rolled print media other than label stock.

17 Claims, 3 Drawing Sheets

APPARATUS TO GUIDE LABEL STOCK IN A PRINTER

TECHNICAL FIELD

The present invention relates to printers and, more particularly, to printers which utilize multiple widths of label stock or other media.

BACKGROUND

Thermal print heads are used for marking various indicia on heat sensitive labels. The labels may be attached to a backing and provided as a roll of label stock. Other types of label stock include linerless or backerless label stock. A roll of label stock is positioned within the printer to move label stock past the thermal print head. The label stock is driven by a roller which moves the label stock past the thermal print head so that the heat of the heating element acts on the heat sensitive labels, thereby marking the labels. Different widths of label stock are commonly used and available. Label printers may also utilize other types of print heads and label stock.

Accordingly, there is a need for a printer that can accommodate various widths of rolled label stock or other print media while at the same time maintaining proper alignment of the label stock or other print media with the print head.

SUMMARY

In one aspect, a label printing apparatus for accommodating a plurality of widths of rolled label stock is provided. The label printing apparatus includes a frame, a label stock support arm extending from the frame, and a print head located for having label stock passed thereby for printing. The label stock support arm includes at least two stepped regions for supporting rolled label stock, including a first stepped region with edges spaced apart by a first distance corresponding to a first width of label stock and a second stepped region with edges spaced apart by a second distance corresponding to a second width of label stock.

In another aspect, a label printing apparatus for accommodating a plurality of widths of rolled label stock is provided. The label printing apparatus of the second embodiment includes a frame, a label stock support arm extending from the frame for supporting a rolled label stock, and a print head. A label stock path extends from the label stock support arm to the print head. A label stock guide is positioned along the label stock path and has at least two recessed guide regions along which label stock can move. Specifically, the label stock guide may include a first recessed guide region sized to correspond to a first width of label stock and a second recessed guide region sized to correspond to a second width of label stock.

In still another aspect, a label printing apparatus for accommodating a plurality of widths of rolled label stock is provided. The label printing apparatus includes a frame, a label stock support arm extending from the frame, and a print head located for having label stock pass thereby for printing. A label stock path extends from the label stock support arm to the print head. At least one wall for positioning alongside the label stock path is provided. The wall is moveable and mountable in at least two positions and includes a first position to guide an edge of label stock of a first width and a second position to guide an edge of label stock of a second width.

It is recognized that any of the foregoing aspects could also be incorporated into a printer using print media other than label stock and that the foregoing aspects could be incorporated into a printer with or without a cassette that holds label stock for easy replacement, such as the label cassette shown and described in U.S. Pat. No. 6,428,225.

DETAILED DESCRIPTION

Figure 1:
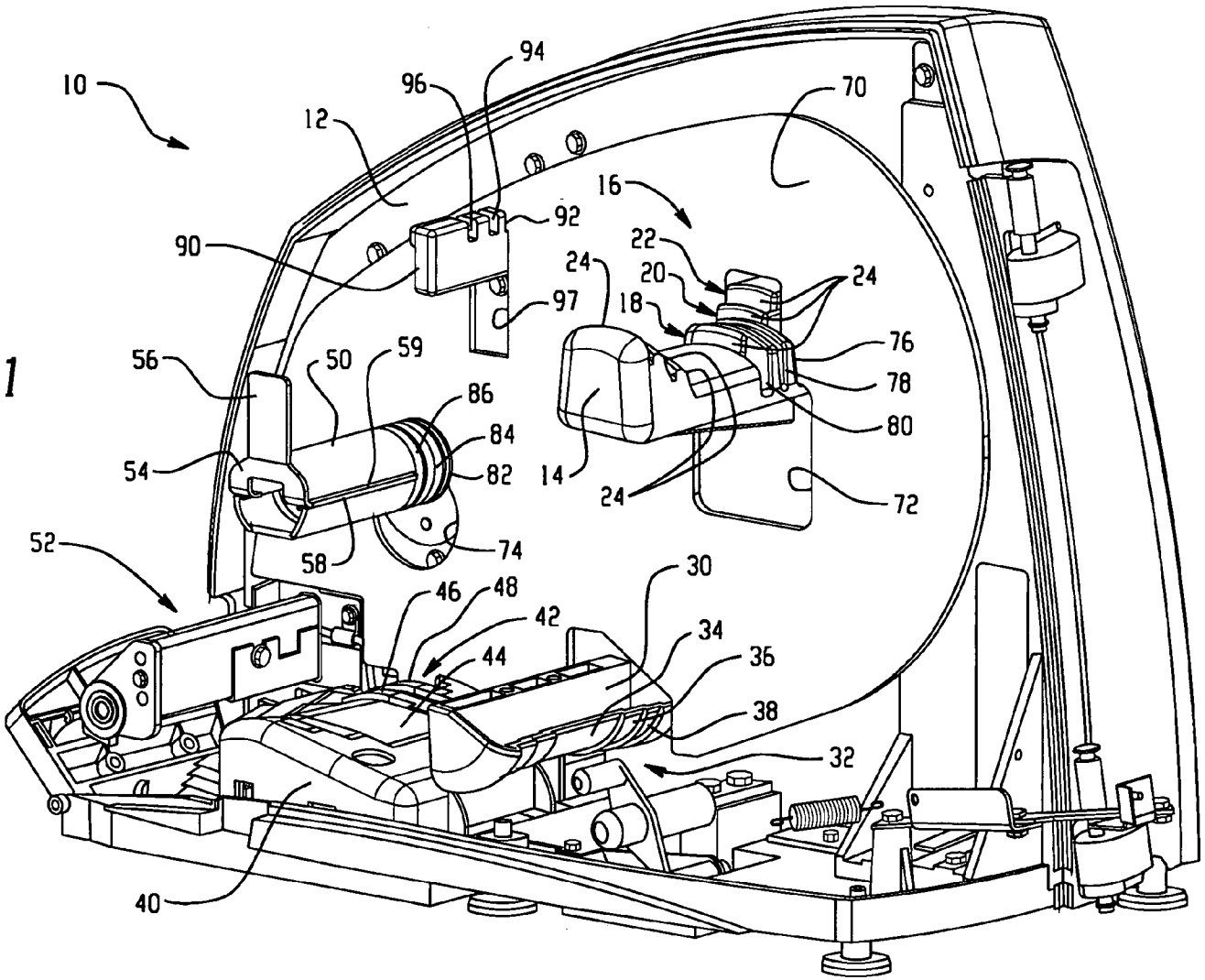
FIG. 1 is a side perspective view of one embodiment of a label printing apparatus.
Figure 2:
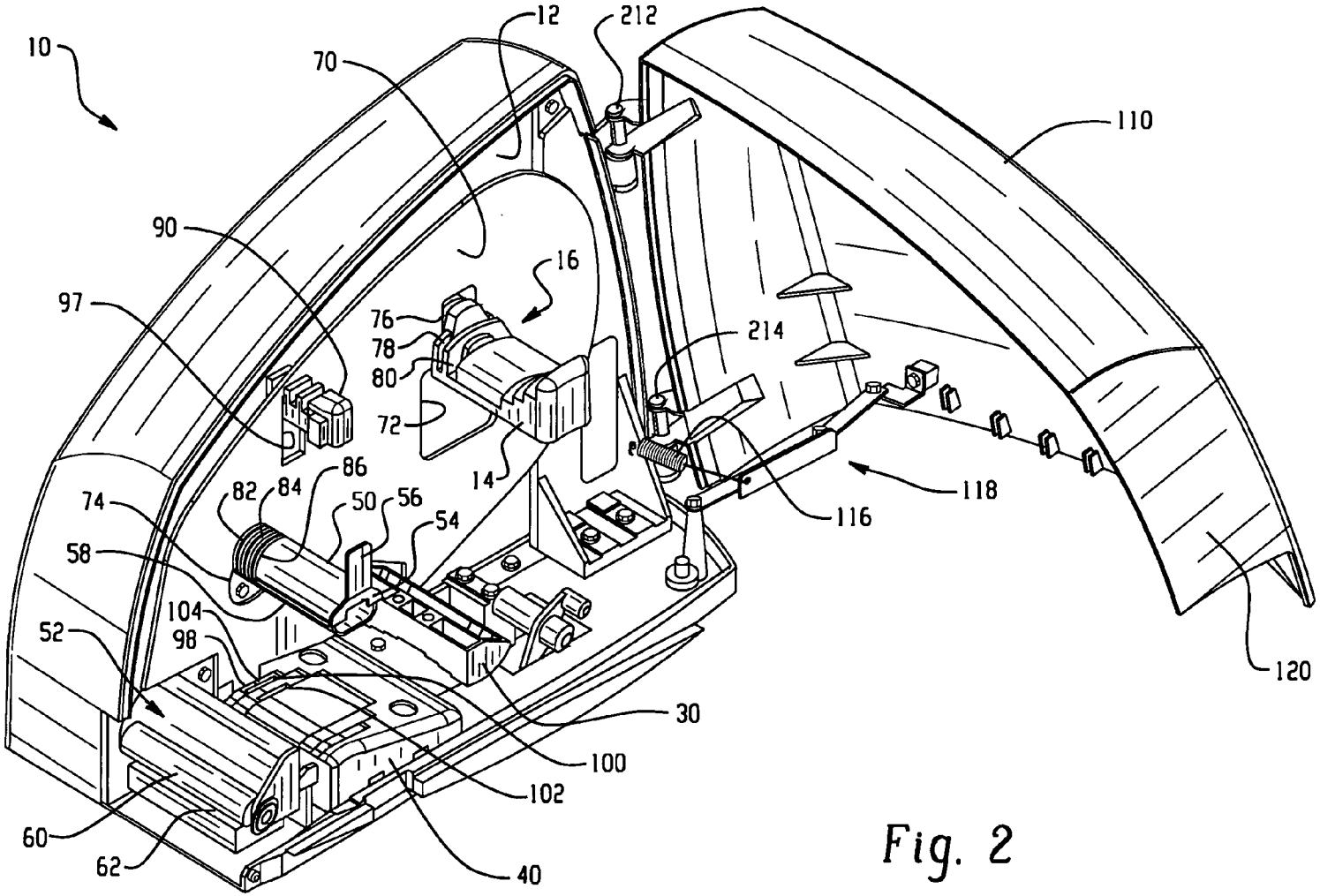
FIG. 2 is another side perspective view of the label printing apparatus of FIG. 1.

As shown in FIGS. 1 and 2, a label printing apparatus, generally designated 10, includes a frame 12 having a label stock support arm 14 extending therefrom. The label stock support arm includes stepped regions 16. Specifically, a smallest size stepped region 18, an intermediate size stepped region 20 and a largest size stepped region 22 are provided. The stepped regions 14 are defined by respective edges 24 that are spaced apart to accommodate various widths (small, intermediate and large) of label stock.

A label stock guide 30 extends from the frame 12 and includes downwardly facing recessed guide regions 32. Specifically, a smallest size recessed guide region 34, an intermediate size recessed guide region 36 and a largest size recessed guide region 38 are provided to accommodate the three different widths of label stock. A lower label stock guide 40 includes upwardly facing recessed guide regions 42, specifically recessed guide regions 44, 46 and 48 to accommodate the three different widths of label stock.

A driven label stock backing reclamation arm 50 extends from the frame 12 and receives and collects the label stock backing after the label stock has passed through a print head assembly 52 and the labels have been removed from the backing. The labels may be removed from the backing by sharply turning the label stock about a pin or edge as is known in the art. Once labels have been removed from the label stock, the backing is collected on the label stock backing reclamation arm 50. Notably, the arm 50 includes a removable key 54 that is used to secure the backing paper to the arm 50. The key 54 includes a part 56 extending radially outward from the end of the arm 50 when the key 54 is installed. Spaced apart fingers 58 of the key engage corresponding slots 59 on the reclamation arm 50.

The print head assembly 52 includes a roller 60 and thermal print head 62 that define a print line 116 (FIG. 3) therebetween through which the label stock passes. The print line 116 runs substantially parallel to the center axis of the roller 60. Referring again to FIGS. 1 and 2, label stock is positioned to pass through the print head assembly 52 such that a center point across the width of the label stock substantially coincides with the center point along the print line.

A wall 70 may be mounted and moveable to accommodate the different label stock widths. Wall 70 includes openings 72 and 74 through which arms 14 and 50 extend. Arm 14 includes wall receiving slots 76, 78 and 80 and arm 50 includes wall receiving slots 82, 84 and 86, with the wall shown mounted in slots 76 and 82. Thus, the wall 70 can be supported in multiple positions by arms 14 and 50. An additional wall support arm 90 is also provided and includes wall receiving slots 92, 94 and 96, with the wall 70 having a corresponding opening 97. Further, the guide 40 includes slots 98, 100 and 102 to receive a downwardly extending leg 104 of the wall.

Figure 3:
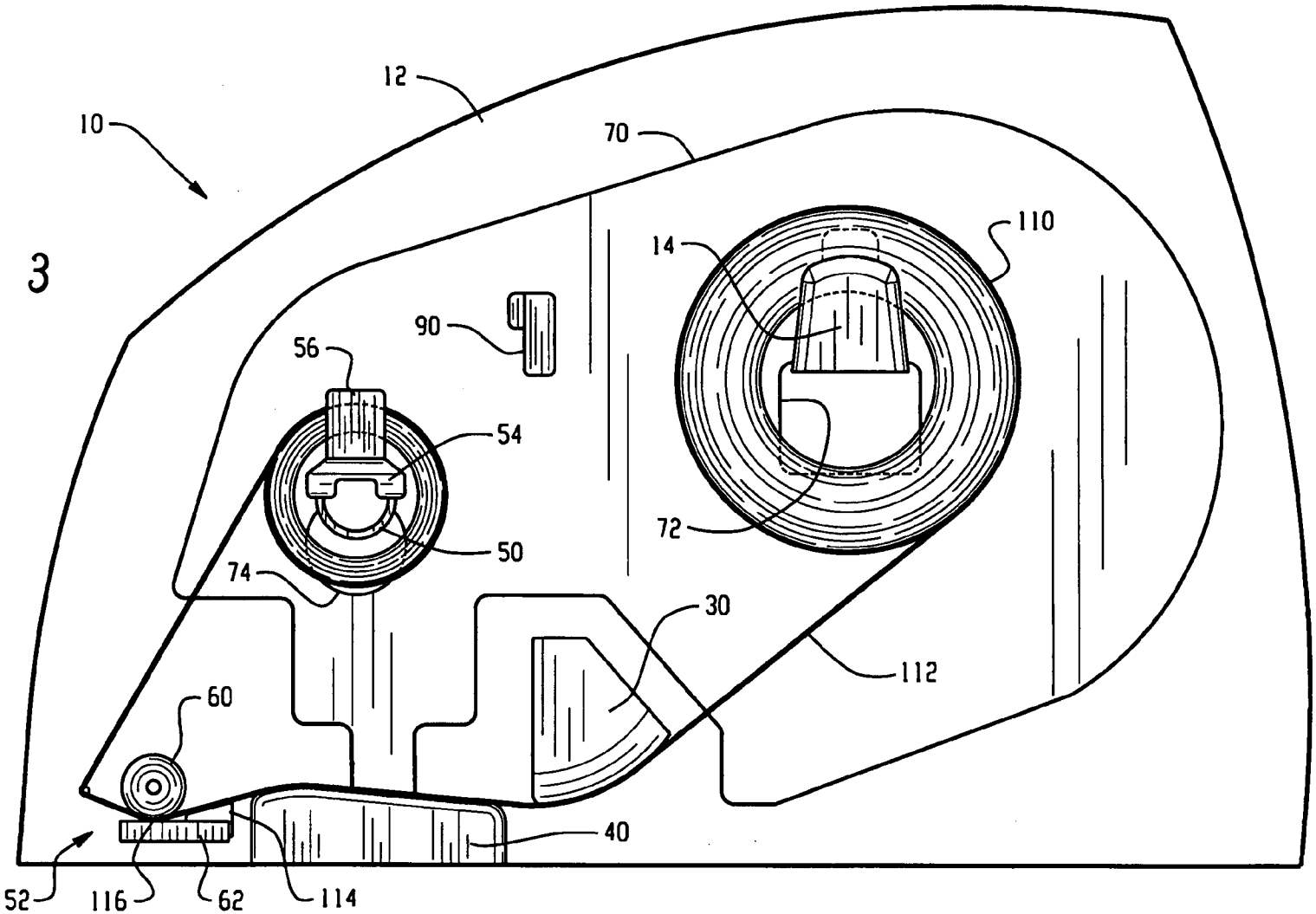
FIG. 3 is a side elevational view depicting an exemplary label stock path.

Referring to FIG. 3, the arm 14 receives a roll of label stock 110 thereon. A label stock path 112 is defined as the path of the label stock as it moves from the rolled label stock 110 past the label stock guides 30 and 40 on its way to print head assembly 52. After passing through the print head assembly used label stock backing can be recollected about label stock backing reclamation arm 50 as shown. Notably, the print head assembly 52 may include a print head cover 114 protecting circuitry on the print head 62, and the cover 114 may include upwardly facing recessed regions similar to those of guide 40. The print line 116 of the print head assembly is also shown.

In use, the illustrated embodiment accommodates three different widths of label stock. For the smallest width of accommodated label stock the label stock supply roll sits in stepped region 18 of arm 14, the label stock moves along the label stock path and is guided by recessed regions 34 and 44 of guides 30 and 40 respectively, and inner wall 70 is mounted in slots 80, 86, 96 and 102 such that the inside facing edge of the label stock moves along the surface of the wall 70. In such case the edge 24 to edge 24 dimension of stepped region 18 and the sizing of recessed regions 34 and 44 corresponds to the width of the smallest accommodated label stock. For the intermediate width of accommodated label stock the label stock supply roll sits in stepped region 20 of arm 14, the label stock moves along the label stock path and is guided by recessed regions 36 and 46 of guides 30 and 40 respectively, and inner wall 70 is mounted in slots 78, 84, 94 and 100 such that the inside facing edge of the label stock moves along the surface of the wall 70. In such case the edge 24 to edge 24 dimension of stepped region 20 and the sizing of recessed regions 36 and 46 corresponds to the width of the intermediate width of accommodated label stock. For the largest width of accommodated label stock the label stock supply roll sits in stepped region 22 of arm 14, the label stock moves along the label stock guide path and is guided by recessed regions 38 and 48 of guides 30 and 40 respectively, and inner wall 70 is mounted in slots 76, 82, 92 and 98 such that the inside facing edge of the label stock moves along the surface of the wall 70. In such case the edge 24 to edge 24 dimensions of stepped region 22 and the sizing of recessed regions 38 and 40 corresponds to the width of the largest width of accommodated label stock.

The illustrated embodiment maintains the label stock centered along the print line. Where the printer is used in combination with an automated label applier, the label position upon exiting the printer is also maintained as desired, regardless of the width of label stock utilized. For example, if a vacuum wand is used to apply labels exiting the printer, the labels can be centered about the axis of the vacuum wand.

The backing paper reclamation arm key 54 is used to secure the backing paper to the arm 50 by partially wrapping the backing paper about the arm 50 while the key 54 is removed and then inserting the key 54 onto the arm such that fingers 58 overlap and trap the backing paper. As the backing paper accumulates on the arm 50 during operation, the extension part 56 acts as a stop to prevent the backing paper from spiraling off the end of the arm, which aids in preventing malfunction of the label feed in the printer.

As best seen in FIG. 2, the printer 10 includes an internal compartment accessible by a pivoting door 110 having hinges 112 and 114 that define a pivot axis toward the rear of the printer. When the door is in the illustrated open position it is biased open by the action of a spring 116 that extends between the frame 12 and a bracket arrangement 118 acting as on over center mechanism. In the illustrated embodiment a front part 120 of the door moves outward and rearward from the front of the printer when the door 110 is pivoted open.

Although the invention is shown and described with respect to certain embodiments it is recognized that variations are possible. While the illustrated embodiment is configured to handle three widths of label stock, configurations handling only two widths or more than three widths are contemplated, in which case the label stock support arm might have a number of stepped regions corresponding to the number of widths of label stock, label stock guides might have an appropriate number of recessed guide regions, and the wall would be movable between an appropriate number of positions. Further, while the illustrated embodiment is described primarily with reference to label stock including a plurality of adhesive labels placed on a backing, it is recognized that backerless label stock, or other types of label stock, could be used by making appropriate modifications to handle the different type of label stock if needed. In addition, in place of label stock a printer including the above described guide features could utilize any other rolled print media. While the described print head is a thermal print head, other types of print heads could be used with appropriate, corresponding types of label stock. While a cassette free printer embodiment is primarily shown, it is recognized that various of the described features could be incorporated into the compartment of a print media cassette that holds the rolled label stock or other print media and is removable from the printer. In such an embodiment a media compartment of the printer cassette might include one or more of a label stock support arm with stepped regions, one or more label stock guides with recessed regions and an internal, movable wall. When such a cassette is installed within a printer the cassette is removably held in place and becomes part of the printer frame. Still further, while in the illustrated embodiment features are configured and positioned to maintain label stock or other print media in a centered position relative to a print line of a print head, various of the features could be used to maintain some other, non-centered reference position about a print line.

What is claimed is:

1. A label printing apparatus for accommodating a plurality of widths of rolled label stock, comprising:

a frame;

a label stock support arm extending from said frame, and having at least two stepped regions for supporting rolled label stock, including a first stepped region with edges spaced apart by a first distance corresponding to a first width of label stock and a second stepped region with edges spaced apart by a second distance corresponding to a second width of label stock; and a print head locate for having label stock pass thereby for printing;

at least one wall mountable in at least two positions alongside a label stock path that extends from the label stock support arm to the print head, including a first position to guide an edge of label stack of the first width and a second position to guide an edge of label stock of the second width.

2. The label printing apparatus of claim 1 further comprising a label stock guide positioned along the label stock path between said label stock support arm and said print head.

3. The label printing apparatus of claim 2 wherein the label stock guide includes at least a first recessed guide region sized to correspond to the first width of label stock and a second recessed guide region sized to correspond to the second width of label stock.

4. The label printing apparatus of claim 1 further comprising a label stock hacking reclamation arm.

5. The label printing apparatus of claim 1 wherein said label stock support arm includes a third stepped region with edges spaced apart by a third distance corresponding to a third width of label stock.

6. The label printing apparatus of claim 1 wherein the print head includes printing elements that define a label print line that extends across the label stock path, and both a center point the first stepped region and a center point of the second stepped region coincide with center point of the label print line.

7. The label printing apparatus of claim 1 wherein the label stock support arm includes at least a first slot for receiving part of moveable wall to aid in holding the moveable wall when in the first and position, and second slot for receiving part of the moveable wall to aid in holding the moveable wall when in the second position.

8. A label printing apparatus for accommodating a plurality of widths of rolled label stock, comprising:

frame;

label stock support arm extending from said frame for supporting rolled label stock;

a print head located for having label stock pass thereby for printing;

a label stack path extending from the label stock support arm to the print head;

at least one wall for positioning alongside the label stock path, the wall moveable and mountable in at least two positions, including a first position to guide an edge of label stock of first width, and a second position to guide and edge of label stock of a second width.

9. The label printing apparatus of claim 8 further comprising a label stock bucking reclamation arm.

10. The label printing apparatus of clam 8 wherein said movable wall is mountable in a third position to guide an edge of label stock of a third width.

11. The label printing apparatus of claim 8 wherein said label stock support arm has at least two stepped regions, including a first stepped region sized to correspond to the first width of label stock amid a second stepped region sized to correspond to the second width of label stock.

12. The label printing apparatus of claim 8 wherein the label stock support arm includes at least two slots for receiving part of the moveable wall to aid in holding the moveable wall, including a first slot for receiving part of the moveable wall to aid in holding the moveable wall when in the first position, and a second slot for receiving part of the moveable wall to aid in holding the moveable wall when in the second position.

13. The label printing apparatus of claim 8 further comprising a label stock guide positioned along a label stock path between said label stock support arm and said print head, and having at least two recessed guide regions along which label stock can travel, including a first recessed guide region sized to correspond to the first width of label stock and a second stepped guide region sized to correspond to the second width of label stock.

14. The label printing apparatus of claim 8 wherein the label stock path includes a centerline that substantially aligns with a center point of a print line of the print head, the print line extending across the label stock path, and in the first position the wall is located a first distance from the centerline and in the second position the wall is located a second distance from the centerline.

15. The label printing apparatus of claim 8 wherein a removable printer cassette includes the label stock support arm and the at least one wall.

16. A print media compartment for accommodating a plurality of widths of rolled print media, comprising:

an inner wall;

a print media support arm extending outward past the inner wall for supporting rolled print media;

a print media path extending from the print media support arm toward one of an opening in time compartment or a print head within the compartment;

a print media guide positioned along the print media path;

wherein the print media compartment includes the following features:

(a) the print media support arm having at least two stepped regions, including a first stepped region with edges spaced apart by a distance corresponding to a first width of print media and a second stepped region with edges spaced apart by a distance corresponding to a second width of print media;

the print media guide having at least two recessed guide regions, including a first stepped guide region sized to correspond to the first width of label stock and a second recessed guide region sized to correspond to the second width of label stock; and (c) the inner wall being movable and mountable in at least two positions relative to the print media path, including a first position to guide an edge of label stock of the first width, and a second position to guide an edge of label stock of the second width.

17. A printing device including the print media compartment of claim 16.

* * * * *

UNITED STATES PATENT AND TRADEMARK OFFICE

CERTIFICATE OF CORRECTION

PATENT NO. : 7,140,794 B2
APPLICATION NO. : 10/769446
DATED : November 28, 2006
INVENTOR(S) : Randall L. Redman et al.

It is certified that error appears in the above-identified patent and that said Letters Patent is hereby corrected as shown below:

Col. 4

Line 56 - Change “locate” to -- located --.
Line 61 - Change “stack” to -- stock --.

Col 5

Line 7 - Change “hacking” to -- backing --.
Line 15 - After “point” insert -- of --.
Line 16 - After “with” insert -- a --.
Line 20 - After “of” insert -- the --.
Line 21 - After “first” delete “and”;
Line 21 - Insert -- a -- before “second”.
Line 26 - Insert -- a -- at beginning of line.
Line 27 - Insert -- a -- at beginning of line.
Line 31 - Change “stack” to -- stock --.
Line 36 - Insert -- a -- after “of”.
Line 37 - Change “and” to -- an --.
Line 39 - Change “bucking” to -- backing --.
Line 40 - Change “clam” to -- claim --.
Line 46 - Change “amid” to -- and --.

Col 6

Line 28 - Change “time” to -- the --.

Signed and Sealed this

Twentieth Day of February, 2007

JON W. DUDAS
*Director of the United States Patent and Trademark Office*